US005544717A

United States Patent [19]

White et al.

[11] Patent Number: 5,544,717

[45] Date of Patent: Aug. 13, 1996

[54] COMBINATION STEP BOLT AND HARNESS ATTACHMENT

[75] Inventors: George W. White, Union Mills; Robert W. Teague, Forest City; Antony D. Tennent, Charlotte, all of N.C.; James A. Robinson, Jr., Rock Hill, S.C.

[73] Assignee: Duke Power Company, Charlotte, N.C.

[21] Appl. No.: 271,358

[22] Filed: Jul. 6, 1994

[51] Int. Cl.[6] ..... E04G 3/00

[52] U.S. Cl. ..... 182/90

[58] Field of Search ..... 182/90, 92, 91, 182/5, 3, 137, 221; 248/231.91

[56] References Cited

U.S. PATENT DOCUMENTS

| | | | |
|---|---|---|---|
| 907,483 | 12/1908 | Ette | 182/90 |
| 1,149,368 | 8/1915 | Johnson | 182/90 |
| 2,957,538 | 10/1960 | Pottmeyer | 182/90 |
| 3,022,855 | 2/1962 | Lewis | 182/3 |
| 4,775,030 | 10/1988 | Wright | 182/92 |
| 5,156,233 | 10/1992 | Olsen | 182/3 |
| 5,287,943 | 2/1994 | Bell | 182/3 |
| 5,417,303 | 5/1995 | Bell | 182/5 X |

*Primary Examiner*—Ramon O. Ramirez
*Attorney, Agent, or Firm*—Shefte, Pinckney & Sawyer

[57] ABSTRACT

A combination step bolt and harness attachment for use with transmission structures and the like comprising a rod member having a threaded end portion and nut that is bolted to the tower to form a projecting step bolt, and a flange member, which may be formed integrally with the wall member or as a separate element, that is disposed between the step bolt and the surface of the transmission tower, such flange member including an opening positioned to receive a hook attached to the harness of a line technician, and including a brace portion projecting downwardly from the step bolt so as to be in abutment with the tower when the combination step bolt and harness attachment is mounted to the transmission tower.

4 Claims, 3 Drawing Sheets

COMBINATION STEP BOLT AND HARNESS ATTACHMENT

BACKGROUND OF THE INVENTION

The present invention relates generally to step bolts that are mounted on transmission structures or the like, and, in particular, to an improved step bolt with an enhanced safety feature.

Recently promulgated OSHA regulations now require that line technicians working on electrical power transmission towers have 100% fall protection when climbing such towers, which means that there must be some safety device in place at all times to prevent the lineman from falling to the ground while working on the transmission tower, or while ascending or descending the tower. These regulations apply not only to new towers but also require retrofitting existing towers to meet the requirements of the regulations.

One known safety system designed to conform to the OSHA regulations includes a shaped rail that must be fixed to the tower to extend along the entire height of the tower, and a sliding device is connected to the rail and then connected to the fall protection harness normally worn by the line technician. While this safety system does provide the necessary fall protection for a line technician, it is expensive both in terms of materials and labor.

Similarly, it is also known to fix a cable along the entire height of the tower, with the cable serving generally the same purpose as the rail described above. This system is also expensive, although somewhat less so than the rail system, and it suffers an additional disadvantage in that the cable, which must be mounted to the tower under tension, is subject to being severed by a lightening bolt striking the tower, in which case the separated cable may come into contact with the high voltage transmission lines carried by the tower.

In accordance with the present invention, the aforesaid drawbacks of known safety systems are eliminated, and a simple and inexpensive step bolt construction is provided which is entirely reliable in meeting the safety requirements of the OSHA regulations.

SUMMARY OF THE INVENTION

The present invention provides a combination step bolt and harness attachment which comprises a generally longitudinally extending rod member having an enlarged head portion at one end thereof, a threaded portion and nut at the other end thereof for mounting the combination step bolt and harness attachment to the power transmission tower, and an intermediate portion having a predetermined length sufficient to receive and support the shoe of a line technician who is working on the tower or ascending or descending the tower. Additionally, a flange member is fixed to the rod member at a location between the threaded portion and the intermediate portion thereof, and this flange member includes an opening positioned beneath the intermediate portion of the rod and sized to receive a hook attached to the harness of the line technician. The flange member also includes a brace portion projecting downwardly from a location between the intermediate portion and the threaded portion of the rod member so as to be in abutment with the transmission tower when the combination step bolt and harness attachment is mounted to the transmission tower, thereby enhancing the ability of the combination step bolt and harness attachment to withstand the stress imposed thereon if the line technician should fall.

In one embodiment of the present invention, the rod member and the flange member are formed as an integral unit and the flange member has a generally U-shaped configuration, with one leg of such U-shaped configuration forming the aforesaid brace portion.

In another embodiment of the present invention, the rod member and the flange member are formed as separate units, and the flange member has a second opening formed in its brace portion, such second opening being sized to permit the threaded portion of the rod member to pass therethrough and be mounted in the transmission tower, whereby such flange member is mounted to the transmission tower by the rod member. In this embodiment, the rod member is preferably formed with an enlarged portion located between the threaded end portion and the intermediate portion thereof, so that the flange portion will be securely held in place between the second enlarged portion and the transmission tower.

BRIEF DESCRIPTION OF THE DRAWINGS

FIG. 1 illustrates one embodiment of the combination step bolt and harness attachment of the present invention, which is shown attached to a transmission tower or the like;

DESCRIPTION OF THE PREFERRED EMBODIMENTS

Figure 1:
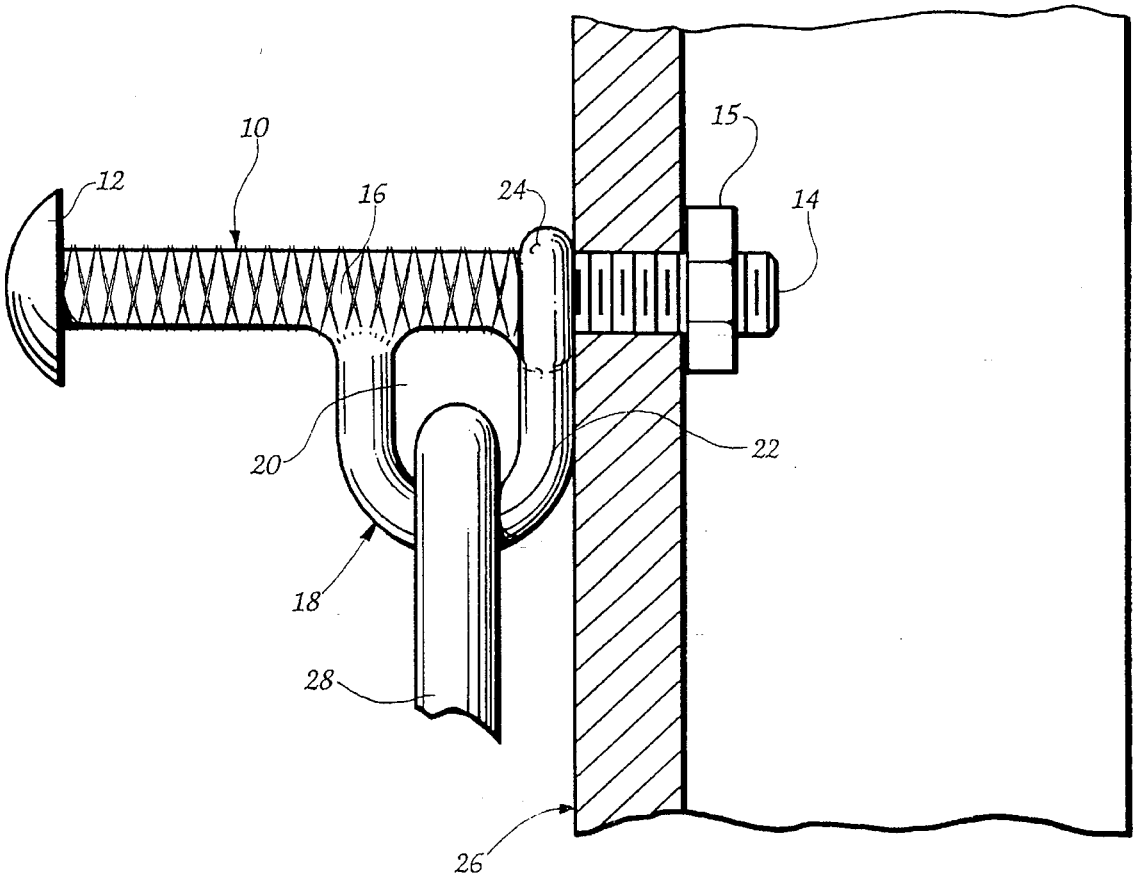

Looking now in greater detail at the accompanying drawings, FIG. 1 illustrates a first embodiment of the present invention which comprises a rod member 10 having a generally longitudinal extent with an enlarged head portion 12 at one end thereof, a threaded portion 14 and nut 15 at the other end thereof, and an intermediate portion 16 having a predetermined length that is sufficient to receive and support the shoe of a line technician standing on the rod member 10, such intermediate portion preferably having a knurled upper surface for improved traction with the line technician's shoe. A flange member 18 having a generally U-shaped configuration is formed integrally with the rod member so as to provide an enclosed opening 20 that is positioned beneath the intermediate rod portion 16 and that is sized to receive a hook attached to the harness of a line technician in a manner to be described in more detail below.

Figure 2:
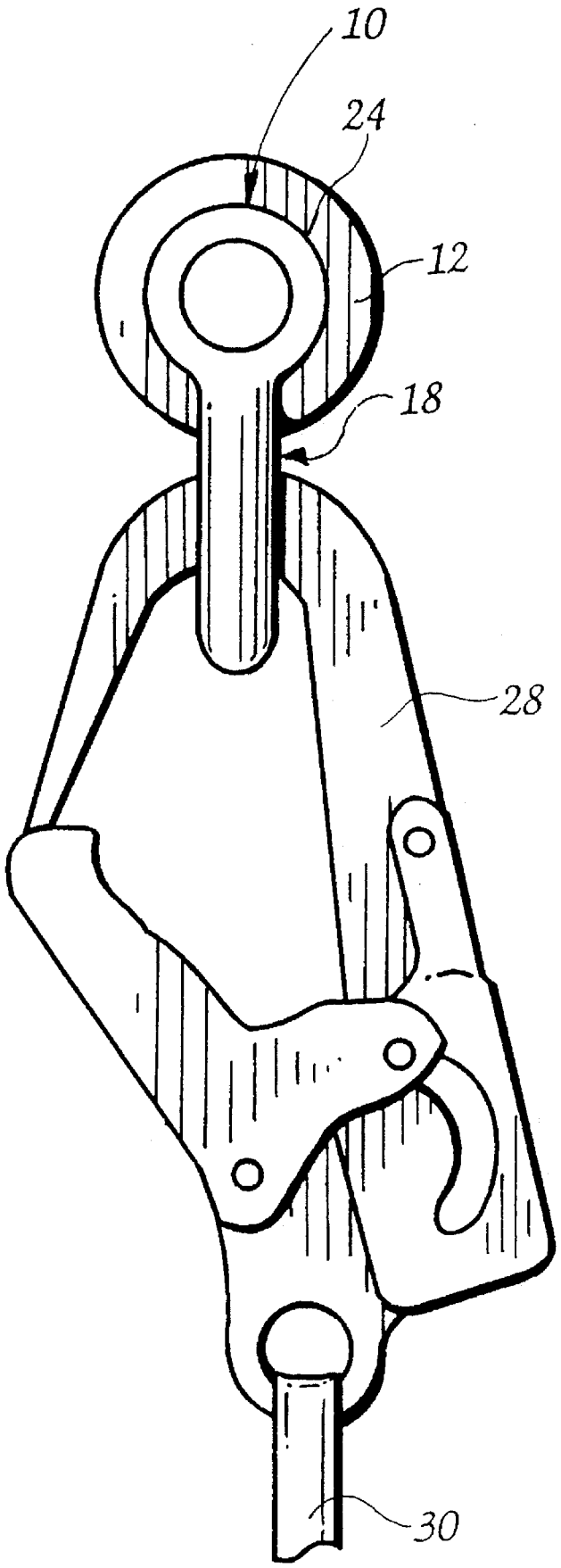
FIG. 2 is an end view of the combination step bolt and harness attachment illustrated in FIG. 1.

One leg 22 of the U-shaped flange member forms a second enlarged portion 24 located between the intermediate rod portion 16 and the threaded end portion 14, and it extends downwardly in a direction generally perpendicular to the longitudinal extent of the rod member 10 to form a brace portion that abuts the surface of the transmission tower 26, only a small portion of which is illustrated in FIG. 1. In FIG. 2, a conventional line technician's hook 28 attached to a lanyard 30 is illustrated extending through the opening 20, and it will be understood that the other end of the lanyard 30 would be secured to a conventional harness (not shown) worn by the line technician.

The first embodiment of the present invention, as described above, can be used in retrofitting existing transmission towers, but its primary use is in conjunction with new transmission towers. In use, and as best seen in FIG. 1, the combination step bolt and harness attachment is mounted on the tower 26 in a conventional manner by screwing the threaded end portion 14 into a threaded receptacle in the tower 26, inserting the threaded end portion 14 through an opening in the tower 26, and causing such threaded end portion 14 to be threaded into a nut 15 until the leg 22 of the flange member 18 is substantially in abutment with the tower 26 as illustrated in FIG. 1. As is well-known, these step bolt arrangements are located at spaced, vertical intervals, and a line technician ascends or descends the tower 26 in a step-by-step progression. To fulfill the safety requirements of OSHA, the line technician wears a known harness (not shown) which has two separate lanyards 30, each of which has a hook 28 secured thereto. The line technician manually inserts one of the hooks 28 in one of the openings 20, then takes one or more steps in the progression, after which the line technician inserts the second hook 28 in the opening 20 of another one of the step bolts 20 and disconnects the original hook 28. The line technician then follows the identical sequence in ascending or descending the tower, and it will be noted that at least one of the hooks 28 is securely held within one of the openings 20 at all times so that if the line technician should slip or fall from the step bolt arrangements, he would be protected from a fall by the hook 28 secured in the opening 20 and the lanyard 30 which is connected to the harness worn by the line technician. It will also be noted that the leg 22, which abuts the tower 26, acts as a bracing portion to enhance the ability of the combination step bolt and harness attachment to withstand the load imposed thereon by the falling line technician.

Figure 3:
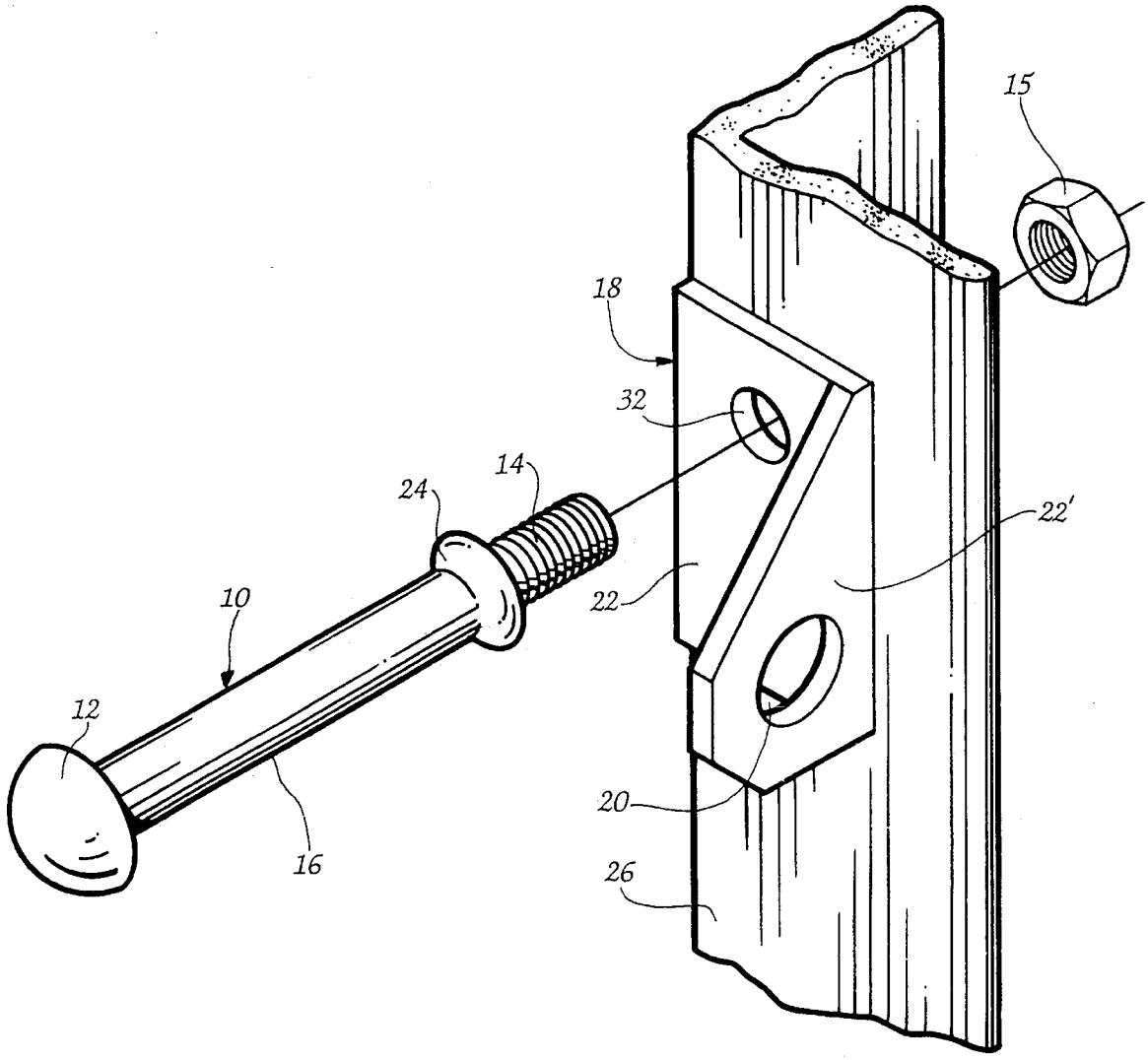
FIG. 3 is a perspective view illustrating a second embodiment of the combination step bolt and harness attachment of the present invention.

FIG. 3 illustrates a second embodiment of the present invention in which reference numerals corresponding to those in FIG. 1 and 2 are used to identify corresponding elements, and in this embodiment the rod member 10 and the flange member 18 are separate elements. The separate flange member 18 is formed of a length of metal bent at right angles to form two legs 22 and 22', with one of the legs 22' being formed with the enlarged opening 20 for receiving the hook 28 on the lanyard 30 and with the other leg 22 being formed with a small opening 32 sized to receive the threaded end portion 14 of the rod member 10.

In this embodiment of the present invention, the rod member 10 is a conventional step bolt which includes the enlarged end portion 12, a threaded end portion 14, and an intermediate step portion 16. A second enlarged portion 24 is formed between the threaded end portion 14 and the intermediate portion 16.

When used to retrofit existing transmission towers, the conventional rod member 10 is unbolted from the tower 26 and the threaded end portion 14 is then inserted through the opening 32 in the leg 22 of the flange member 18, and the threaded end portion 14 is screwed back into the tower 28 as illustrated in FIG. 3. It will be noted that the leg 22 of the flange member 18 is held against the surface of the tower 26 by the enlarged portion 24 so that the leg 22 forms a brace portion for the combination step bolt and harness attachment in the same manner as that described above in connection with the embodiment shown in FIGS. 1 and 2. Also, it will be noted that the second leg 22' of the flange member 18 projects outwardly from the tower to present the enlarged opening 20 in a convenient position for attaching thereto the hook 28. Thus, the second embodiment of the present invention permits an existing tower to be retrofitted by using the existing step bolts provided by the rod member 10, and simply adding the separate flange member, all of which reduces the overall expense and labor requirements of the retrofit as a whole. Once the separate rod member 10 and flange member 18 through the opening in the tower 26 and then bolted at the back of tower 26 with the nut 15 are installed as shown in FIG. 3, the line technician utilizes the openings 20 in the same manner as that described above.

Both embodiments of the present invention provide a simple and inexpensive device which can be used with the new transmission towers or in retrofitting existing towers, and they also provide a device that will provide the 100% fall protection required by OSHA regulations. Finally, it will be appreciated that the labor costs required to install the combination step bolt and harness attachment of the present invention is substantially less than the labor cost associated with the known safety systems described above.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A combination step bolt and harness attachment for use with transmission structures comprising:

a generally longitudinally extending rod member having an enlarged head portion at one end thereof, a threaded portion at the other end thereof for mounting the combination step bolt and harness attachment to the transmission structure, and an intermediate portion having a predetermined length sufficient to receive and support the shoe of a person climbing the transmission structure, and a flange member fixed to said rod member at a location between said threaded portion and said intermediate portion thereof, said flange member including an opening therein positioned beneath said intermediate portion of said rod and fixed to receive a hook attached to the harness of a person, wherein said flange member and said rod member are formed as separate units and said flange member has a second opening, said second opening being sized to permit said threaded portion of said rod member to pass therethrough, whereby said flange member can be mounted to said transmission structure by said rod member.

2. A combination step bolt and harness attachment as defined in claim 1, wherein said flange member includes a brace portion projecting downwardly from a location between said intermediate portion and said threaded portion of said rod member so as to be in abutment with the transmission structure when said combination step bolt and harness attachment is mounted to the transmission structure.

3. A combination step bolt and harness attachment as defined in claim 2, wherein said second opening is formed in said brace portion.

4. A combination step bolt and harness attachment as defined in claim 3, wherein said rod member has a second enlarged portion formed between said threaded end portion and said intermediate portion thereof, whereby said flange portion will be securely held between said second enlarged portion and the transmission structure.

* * * * *